US005616262A

United States Patent [19]

Itoda et al.

[11] Patent Number: 5,616,262

[45] Date of Patent: Apr. 1, 1997

[54] IMAGE ERASING APPARATUS HAVING AN ASSEMBLY FOR MOVING HEAT APPLICATORS

[75] Inventors: Kouichi Itoda, Ohizumimachi; Yoshio Sutoh, Kiryu, both of Japan

[73] Assignee: Ricoh Company, Ltd., Tokyo, Japan

[21] Appl. No.: 422,173

[22] Filed: Apr. 14, 1995

Related U.S. Application Data

[62] Division of Ser. No. 312,625, Sep. 27, 1994, Pat. No. 5,538,822.

[51] Int. Cl.[6] ..... H05B 3/06

[52] U.S. Cl. ..... 219/216; 219/445; 219/459

[58] Field of Search ..... 219/266, 445, 219/459; 347/179; 430/19

[56] References Cited

U.S. PATENT DOCUMENTS

| | | | |
|---|---|---|---|
| 2,792,778 | 5/1957 | Schlegel et al. | 101/69 |
| 3,038,994 | 6/1962 | Nelson et al. | 219/216 |
| 3,856,460 | 12/1974 | Hynes et al. | 219/216 |
| 4,181,560 | 1/1980 | Maitland | 101/27 |
| 4,542,690 | 9/1985 | Kikuchi | 101/27 |
| 4,621,443 | 11/1986 | Weinreich | 40/436 |
| 4,695,528 | 9/1987 | Dabisch et al. | 430/290 |
| 4,857,908 | 8/1989 | Kogure et al. | 345/105 |
| 5,157,011 | 10/1992 | Okabe et al. | 503/201 |
| 5,391,872 | 2/1995 | Itoh et al. | 250/316.1 |
| 5,448,065 | 9/1995 | Masubuchi et al. | 250/316.1 |

FOREIGN PATENT DOCUMENTS

| | | |
|---|---|---|
| 55-154198 | 11/1980 | Japan . |
| 63-39379 | 2/1988 | Japan . |
| 63-39376 | 2/1988 | Japan . |
| 63-178079 | 7/1988 | Japan . |
| 1-14079 | 1/1989 | Japan . |
| 3-142279 | 6/1991 | Japan . |
| 5-286208 | 11/1993 | Japan . |
| 6-15954 | 1/1994 | Japan . |
| 6-15958 | 1/1994 | Japan . |
| 6-24129 | 2/1994 | Japan . |

*Primary Examiner*—Teresa J. Walberg
*Assistant Examiner*—Gregory L. Mills
*Attorney, Agent, or Firm*—Oblon, Spivak, McClelland, Maier & Neustadt, P.C.

[57] ABSTRACT

An image erasing apparatus is provided having an assembly for moving at least one of the heat applicators or heat application means with respect to the other. The apparatus includes a movable member upon which one of the heat application means is mounted, with the movable member movable relative to a fixed frame assembly so that first and second heat application means can be moved toward and away from one another for applying heat to both a front image bearing side and a back side of an image recording medium for erasing images.

15 Claims, 7 Drawing Sheets

IMAGE ERASING APPARATUS HAVING AN ASSEMBLY FOR MOVING HEAT APPLICATORS

This is a division of application Ser. No. 08/312,625 filed on Sep. 27, 1994 now U.S. Pat. No 5,538,822 issued Jul. 23, 1996.

BACKGROUND OF THE INVENTION

1. Field of the Invention

The present invention relates to a method of erasing images recorded in an image recording medium capable of recording images therein and erasing the same therefrom by the application of heat thereto, and an apparatus for conducting this image erasing method.

2. Discussion of Background various kinds of image recording media capable of recording images therein and erasing the same therefrom by the application of heat thereto have been proposed.

Representative examples of such image recording media are (1) a reversible thermosensitive recording material comprising a support and a thermosensitive recording layer formed thereon, which thermosensitive recording layer comprises a matrix resin and an organic low-molecular-weight material dispersed in the matrix resin, as disclosed in Japanese Laid-Open Patent Application 55–154198 and U.S. Pat. 4,695,528; (2) a reversible thermosensitive recording material of the above-mentioned type with an improved reversible thermosensitivity by the addition of a variety of additives to a thermosensitive recording layer thereof as disclosed in Japanese Laid-Open Patent Applications 63–39378 and 63–178079; and (3) reversible thermosensitive materials of the same type as mentioned above, with additional layers being provided thereon for use in practice as disclosed in Japanese Laid-Open Patent Applications 63–39376 and 1–14079, and Japanese Laid-Open Utility Model Application 2–3876.

In these reversible thermosensitive recording materials, image formation and erasure are performed by utilizing their characteristics that the transparency of a thermosensitive recording layer thereof changes depending upon the temperature thereof. The principle of such image formation and erasure is described in detail in U.S. Pat. 4,695,528.

Various methods of erasing images recorded in such a reversible thermosensitive recording material have been conventionally proposed. For example, when the reversible thermosensitive recording material comprises a support and a reversible thermosensitive recording layer formed thereon, there has been proposed an image erasing method by which heat is applied to the recording material on the side of the thermosensitive recording layer, or on the other side thereof, opposite to the thermosensitive recording layer, by use of a heat roller, a thermal head or a one-side heating member. The latter method is disclosed, for example, in Japanese Laid-Open Patent Application 3–142279.

None of any of the above-mentioned conventional methods, however, can attain the formation of a completely and uniformly transparent state by erasing recorded images from the recording material in a shorn period of heat-application time.

SUMMARY OF THE INVENTION

It is therefore a first object of the present invention is to provide a method of thoroughly erasing images recorded in an image recording medium capable of recording images and erasing the same by application of heat thereto, even by applying heat to the recording medium for a short period of time, thereby erasing images and producing a completely and uniformly transparent state in the image recording medium.

A second object of the present invention is to provide an apparatus capable of performing the above-mentioned method of erasing images from the above-mentioned image recording medium.

The first object of the present invention can be achieved by a method of erasing images recorded in the image recording medium, comprising the step of applying heat to both a front image-bearing side and a back side of the image recording medium for erasing images.

Furthermore, in the above-mentioned image erasing method, both sides of the recording medium may be heated with a different heat application phase or period for erasing images.

Furthermore, in the above-mentioned image erasing method, the front image-bearing side of the recording medium may be heated to a temperature higher than that of said back side thereof for erasing images.

The second object of the present invention can be achieved by an apparatus for erasing images recorded in the above-mentioned image recording medium, comprising a pair of heat application means capable of applying heat to both e front image-bearing side and a back side of said image recording medium for erasing images, with the image recording medium being interposed between the pair of heat application means.

In the above-mentioned image erasing apparatus, at least one of the pair of heat application means may be a heating element comprising a plane heating surface.

Furthermore, the above-mentioned image erasing apparatus may further comprise means for separating the pair of heat application means from each other.

Furthermore, the above-mentioned image erasing apparatus may further comprise a cushioning layer which is provided on the surface of at least one of said pair of heat application means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAIL DESCRIPTION OF THE PREFERRED EMBODIMENT

An image recording medium for use in the present invention is not limited to a recording medium which can reversibly change the transparency thereof, depending on the temperature thereof, but may be all kinds of recording media capable of recording images therein and erasing recorded images therefrom by application of heat thereto.

The image erasing method and apparatus of the present invention can be applied to various types of information recording cards as disclosed in Japanese Laid-Open Utility Model Application 2–3876.

As the materials and methods for producing such recording media for use in the present invention, any and all kinds of conventionally known materials and methods can be employed.

For example, in the case of en image recording medium comprising a thermosensitive recording layer and a support for supporting the thermosensitive recording layer thereon as disclosed in U.S. Pat. No. 4,695,528, the term "front image-bearing side" employed in the present invention means a front side of the recording medium on a thermosensitive recording layer side thereof, and the term "back side" means a back side of the support, opposite to the thermosensitive recording layer with respect to the support.

In the method of erasing images according to the present invention, the object of erasing images can be effectively attained by heating both the front image-bearing side and back side of the image recording medium with a different heat-application phase or period. This is because the recording medium can be uniformly heated by such a method.

This will now be explained with reference to FIGS. 1(*a*) and 1(*b*).

Figure 1A:
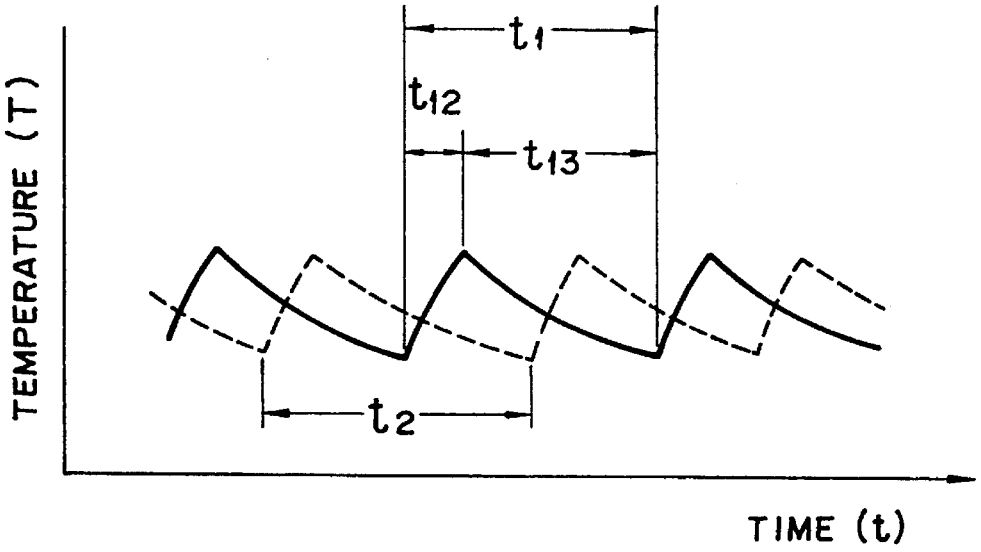
FIGS. 1(*a*) and 1(*b*) are graphs in explanation of the phase and the period for heat application with respect to both sides of an image recording medium.
Figure 1B:
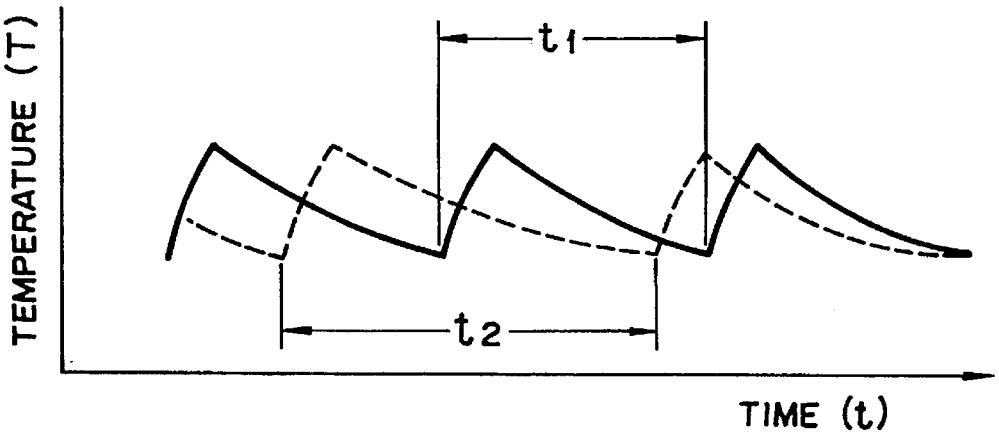

A solid line in each of FIG. 1(*a*) and FIG. 1(*b*) shows changes in the temperature (T) of a thermosensitive recording layer side (i.e. the front image-bearing side) of an image recording medium with time (t) during an image erasure process; and a broken line in each of FIG. 1(*a*) and FIG. 1(*b*) shows changes in the temperature (T) of a back side of the image recording medium with time (t) during the above-mentioned image erasure process.

As shown in FIG. 1(*a*), the front image-bearing side of the recording medium is heated for a period of $t_{12}$, so that the temperature of the front image-bearing side is increased during this period of time. Then, the heat application is stopped for a period of $t_{13}$, so that the temperature of the back side is decreased during this period of time. The total of the above-mentioned period $t_{12}$ and period $t_{13}$ constitute one image erasing period $t_1$ , which is a period from the initiation of the heat application period $t_{12}$ through the initiation of the next heat application period.

Furthermore, as shown in FIG. 1(*a*), the image erasing period $t_1$ for the front image-bearing side is the same as the corresponding erasing period $t_2$ for the back side of the recording medium, although the two periods $t_1$ and $t_2$ are shafted with a phase difference therebetween.

In contrast to this, in the case as shown in FIG. 1(*b*), the image erasing period $t_1$ for the front image-bearing side is different from the corresponding image erasing period $t_2$ for the back side of the recording medium, and the two periods $t_1$ and $t_2$ are shifted with a phase difference therebetween.

In the case as shown in FIG. 1(*a*), the temperature of the image recording medium can be made uniform. However, in the case as shown in FIG. 1(*b*), the changes in temperature of the recording medium are moderate, but slight undulate. However, such undulation of the temperature causes no problems in practical use.

In the present invention, when the temperature of the front image-bearing side of the image recording medium is made higher than the temperature of the back side thereof, not only images can be effectively erased from the image recording medium, but also the image recording medium can be effectively prevented from being deformed, in particular, when the image recording medium is a card-shaped information recording medium, so that this image erasing method is useful to avoid the deformation of the image recording medium. Specifically, it is preferable that the temperature of the front image-bearing side be controlled in a range of 80° to 95° C., and the temperature of the back side be in a range of 30° to 70° C.

Representative examples of the heat application means for erasing recorded images for use in the present invention are (a) heat application member comprising a plane heating surface, such as a hot stamp, which will be hereinafter collectively referred to as a heat plate; (b) a heat roller; and (c) a hot-air generating blower.

Figure 2A:
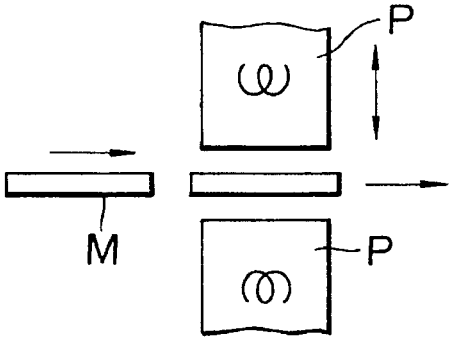
FIG. 2(*a*) to 2(*c*) are schematic cross-sectional views of examples of the heat application means for use in an image erasing apparatus according of the present invention.
Figure 2B:
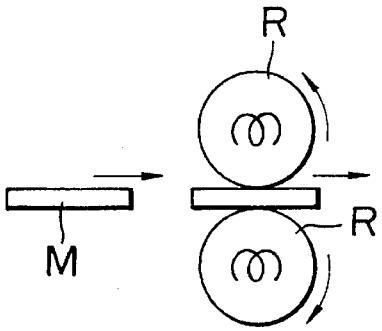
Figure 2C:
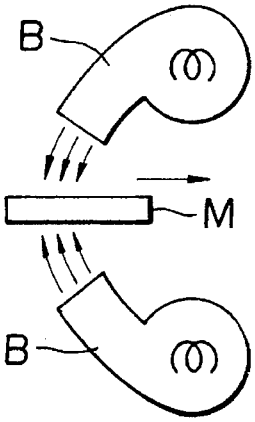

FIGS. 2(*a*) to 2(*c*) respectively schematically show the above-mentioned heat application means. More specifically, FIG. 2(*a*) is a schematic cross-sectional view of the above-mentioned heat plate.

In FIG. 2(*a*), P indicates a heat plate member, and M indicates an image recording medium which is transported between a pair of the heat plate members P in the direction of the arrows.

In FIG. 2(*b* ), R indicates a heat roller, and an image recording medium M is transported between a pair of the heat rollers R in the direction of the arrows.

In FIG. 2(*c*), B indicates a hot-air generating blower from which hot air is caused to blow against the image recording medium which is transported between a pair of hot-air generating blowers in the direction of the arrows.

In FIGS. 2(*a*) to 2(*c*), a pair of the same heating members is employed in such a manner that the image recording medium M is interposed between the pair of the upper and lower heating members. However, it is not always necessary that the upper and lower heating members be the same, but the upper and lower heating members may be different, and may be selected from the abovementioned heating members.

Figure 3:
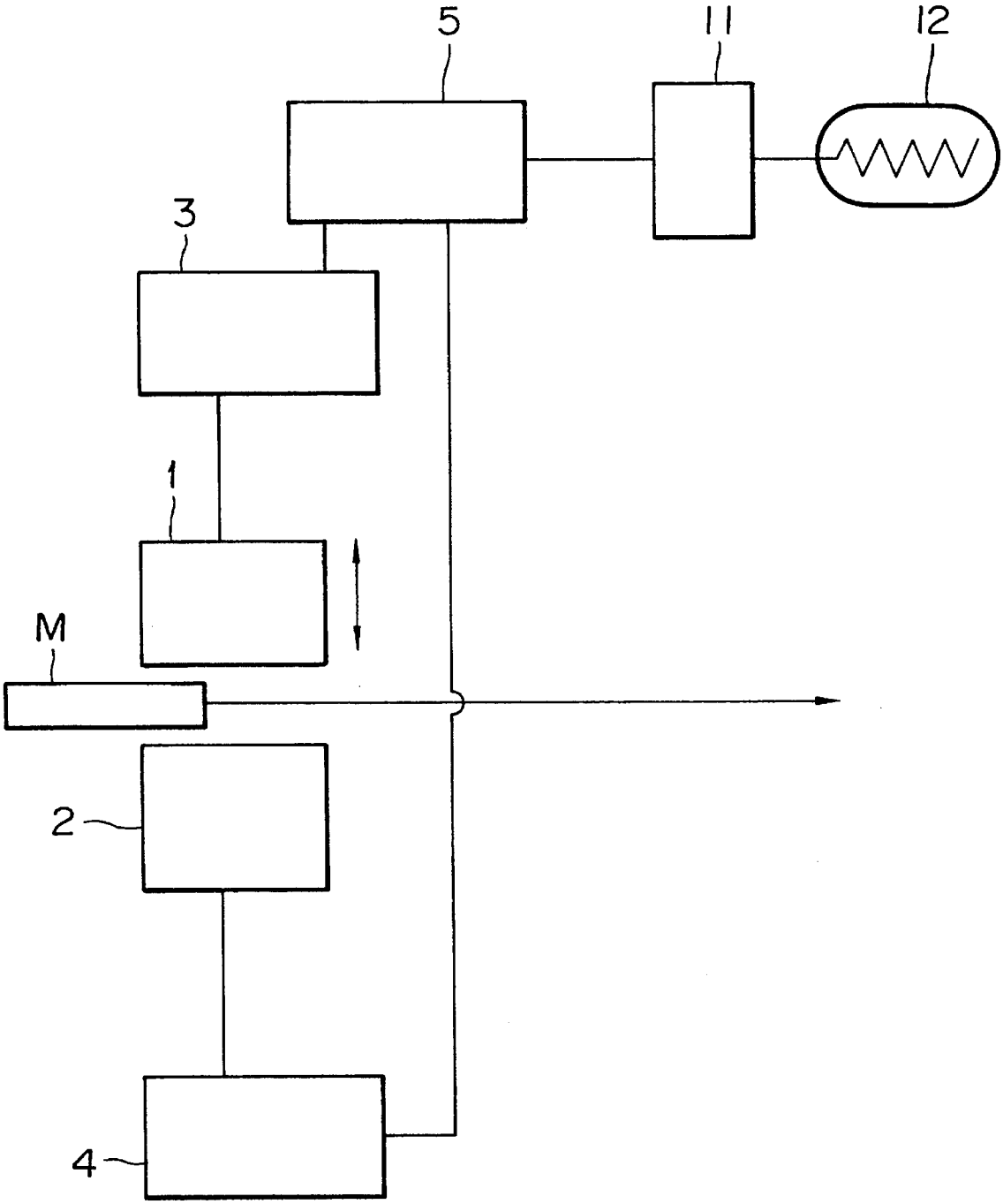
FIG. 3 is a block diagram of the overall structure of an example of an image erasing apparatus according to the present invention.

FIG. 3 is a block diagram of the overall structure of an example of an image erasing apparatus according to the present invention. This image erasing apparatus comprises heat application means 1 and 2, each comprising a heat plate, which are provided vertically with respect to a transporting path of an image recording medium M in she direction of the arrow in such a configuration that the recording medium M is interposed between the heat application means 1 and 2. The image erasing apparatus shown in FIG. 3 further comprises control circuits 3 and for controlling the heat application means 1 and 2, respectively; a controller 5; a CPU 11 for controlling the overall operation of the image erasing apparatus; and temperature detecting means 12.

The temperature detecting means 12 which comprises a thermistor detects the ambient temperature and inputs the data of the detected ambient temperature to the CPU 11. In this image erasing apparatus, the relationship between the ambient temperature, and the heating temperatures of the heat-application means 1 and 2, the heating time or the transporting speed of the image recording medium M is stored in advance in the CPU 11, so that appropriate conditions for the image erasing operation are determined in accordance with the data of the ambient temperature input into the CPU 11. Based on signals in accordance with the thus determined conditions for image erasing, erasing conditions such as heating temperature, heating time and the transporting speed of the recording medium M are determined through the controller 5. When the ambient temperature is low, the heating temperature is generally increased, the heating time is prolonged, and the transporting speed of the recording medium M is decreased in order to keep the temperature of the image recording medium M constant. Thus, even when image erasure becomes difficult under preset conditions because of the lowering of the ambient temperature, the image erasing conditions are appropriately changed in accordance with the current ambient temperature, so that images recorded in the image recording medium M can be uniformly erased.

As an example of a practically useful image erasing apparatus suitable for a card-shaped recording medium, there can be given an image erasing apparatus comprising a heat plate as heating means.

The advantages of the heat plate over other heating means are that any limited area to be erased can be designated as desired in the recording medium more easily as compared with a heat roller, and that the heating time can be maximized within a limited available image erasing time of the image erasing apparatus.

A disadvantage of the heat plate is that it is difficult to maintain the temperature of the heat plate uniform when the heat plate has a large heating area.

In view of the above-mentioned characteristics of the heat plate, it is considered that current$_1$ the heat plate is most suitable for use in a high-speed image erasing apparatus for a thin, flexible recording medium with a small area, such as a card-shaped recording medium.

Furthermore, in the case of an image erasing apparatus which erases images by bringing a heating member such as a heat plate or a heat roller into direct contact with the image recording medium, a cushioning layer may be provided on the surface of such a heating member to uniformly heat the recording medium and improve the erasing performance of the heating member. As a material for such a cushioning layer, a cushioning material with high thermal conductivity, for example, silicone rubber and fluorine-containing rubber are preferably employed.

An example of an image erasing apparatus according to the present invention which comprises heat plates as heating means for image erasure will now be explained in detail with reference to FIGS. 4 to 6.

Figure 4:
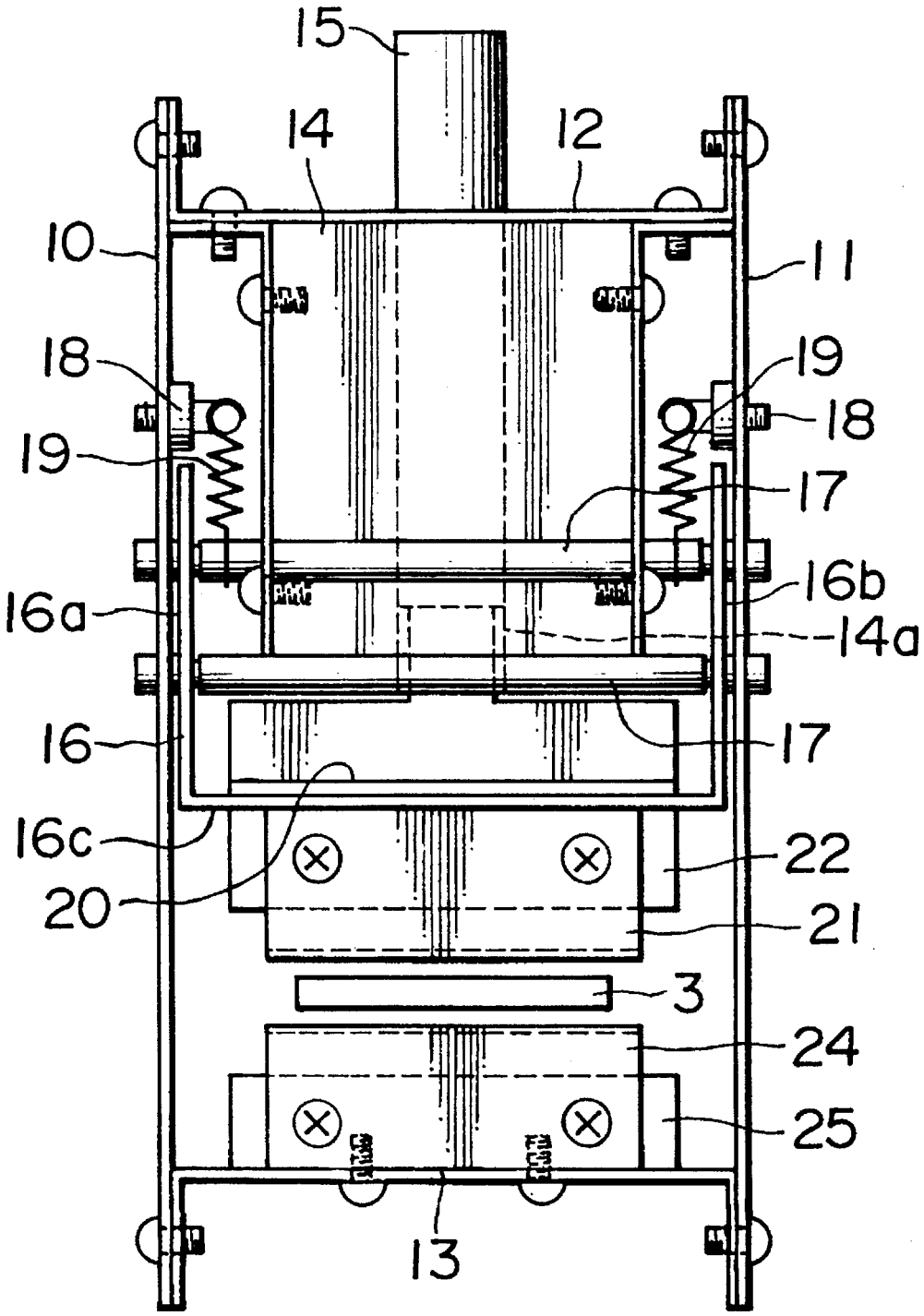
FIG. 4 is a front view of an example of an image erasing apparatus according to the present invention
Figure 5:
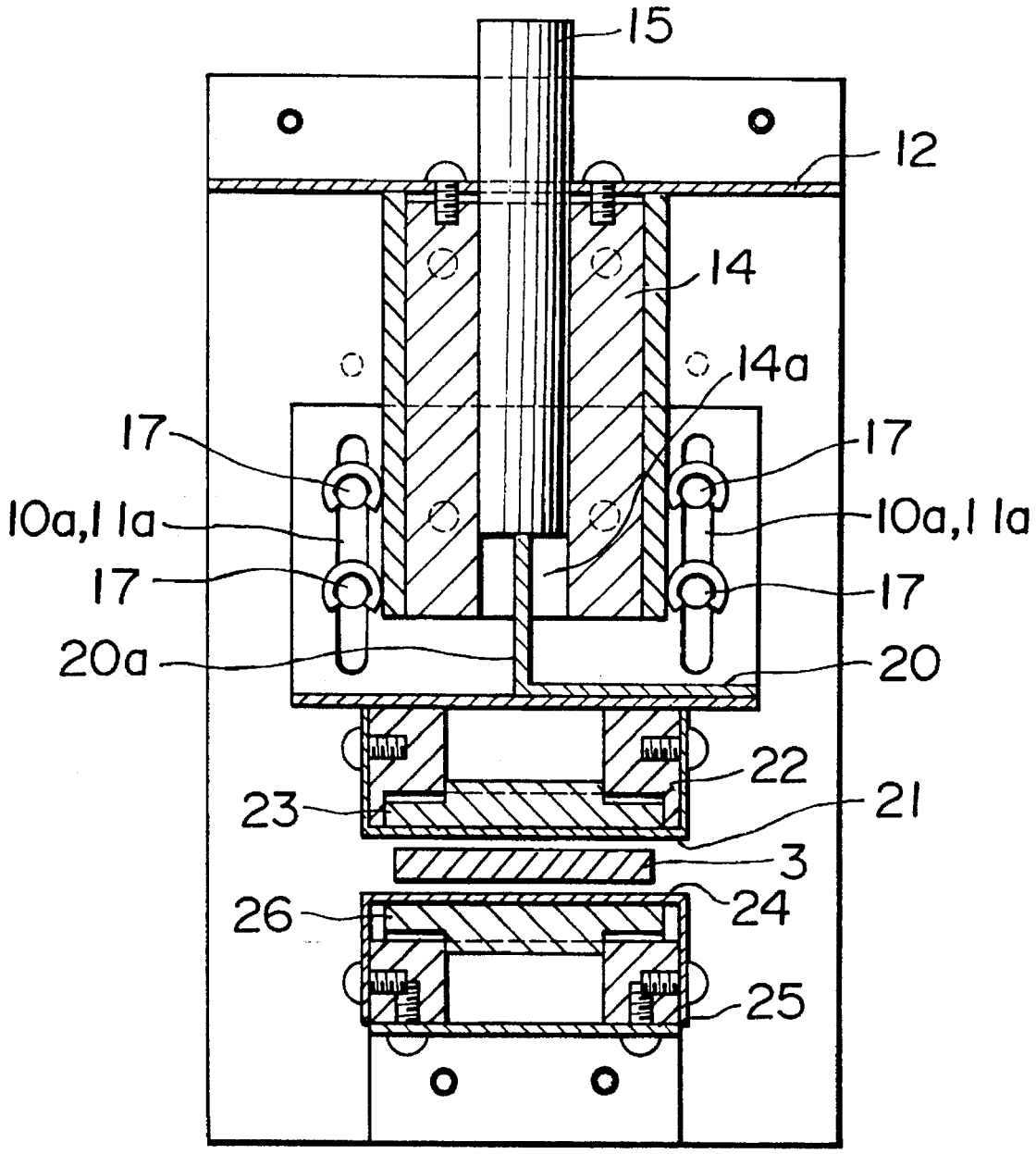
FIG. 5 is a side view of the image erasing apparatus as shown in FIG. 4.
Figure 6:
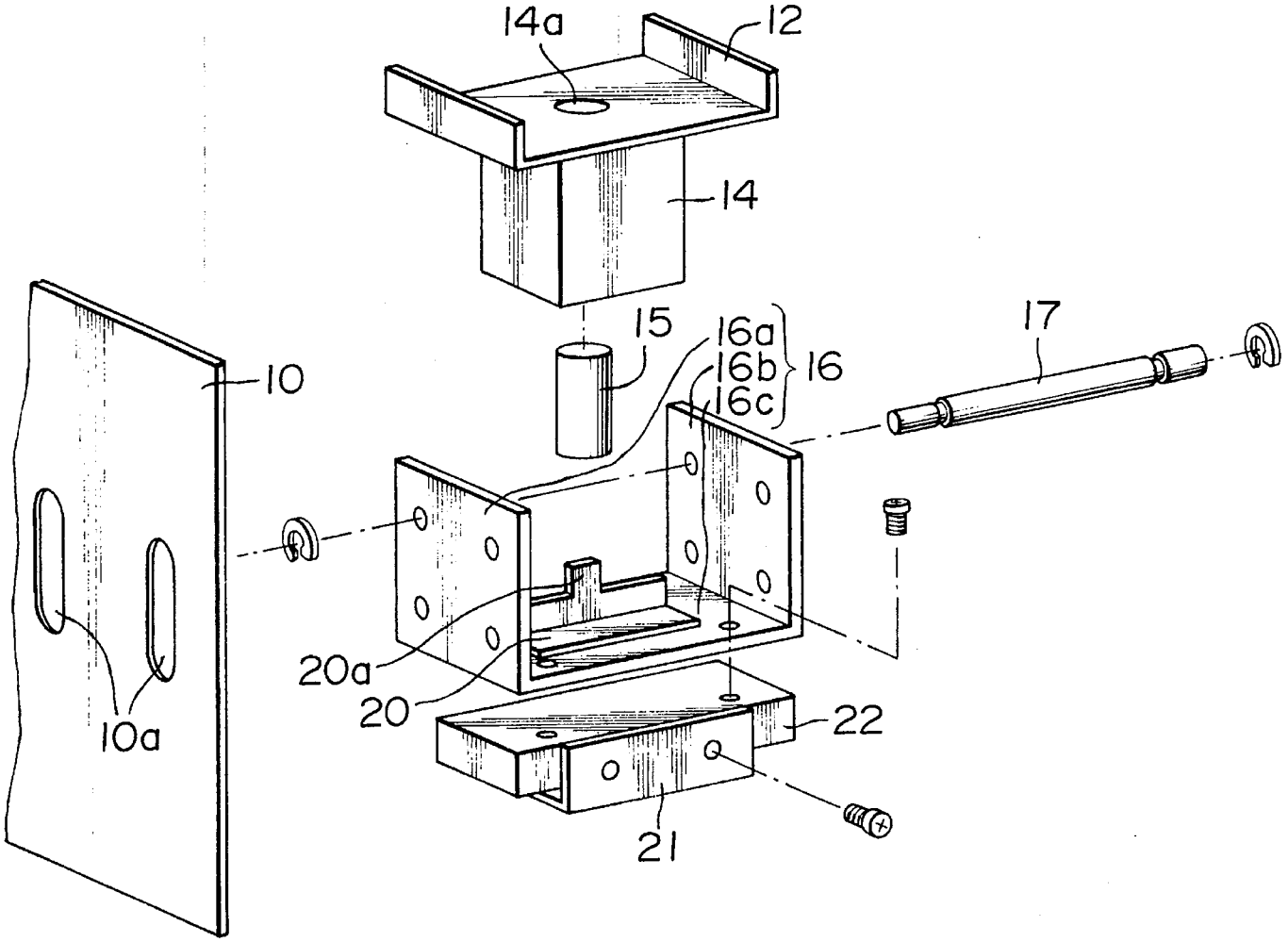
FIG. 6 is a partial, exploded perspective view of the image erasing apparatus as shown in FIG. 4.

The image erasing apparatus as shown in FIGS. 4 through 6 is characterized by comprising two heat-application means, and means for separating the two heat application means from each other.

In the above image erasing apparatus, reference numerals 10 and 11 indicate side walls of a cabinet, which are integrally connected by upper and lower metal connecting members 12 and 13. A solenoid 14 is fixed to the upper connecting member 12. Reference numeral 15 indicates a movable axis of the solenoid 14. Reference numeral 16 is a movable member which is composed of side walls **16*a* and 16*b* and a bottom plate 16*c*, and four guide bars 17, that is, front upper, front lower, back upper, and back lower bars, are fixedly passed through the side walls 16*a* and 16*b* as shown in FIG. 6. The projected end portions of the guide bars 17 are fitted in slots 10*a* and 11*a* respectively provided on the side walls 10 and 11 in a vertically movable fashion along the slots 10*a* and 11*a* as shown in FIG. 5**.

Reference numeral 18 shown in FIG. 4 indicates pins which are fixed to an upper portion of each of the slots **10*a* and 11*a*. A spring 19 is provided between the pin 18 and each of the upper guide bars 17 in such a manner that the movable member 16 is always urged in the upper direction by the spring 19**.

A member 20 is provided with a profrusion **20*a* which in fitted into a lower portion of a central hole 14*a* of the solenoid 14, and is fixed on the upper surface of the bottom plate 16*c* of the movable member 16**.

On the lower surface of the bottom plate **16*c*, a fixture 22 is fixed, by which a heating element 23 and an upper head application medium 21 including a flat lower surface are fixed. The heating element 23 and the heat application medium 21** in combination constitute an upper heat application means in the image erasing apparatus.

On the upper surface of the lower metal connecting member 13, a lower fixture 25 is fixed, by which a heating element 26 and a lower heat application medium 24 including a flat upper surface are fixed. The heating element 26 and the lower heat application medium 24 constitute a lower heat application means in the image erasing apparatus.

The image erasing operation will now be explained.

when the solenoid 14 is not energized, the guide bars 17 are pulled upward by the pins 18 and are engaged in the upper ends of the slots **10*a* and 11*a*, so that the upper heat application medium 21 which is integral with the movable member 16 is positioned at a predetermined distance away from the lower heat application medium 24**.

An image recording medium 3 which bears images thereon is caused to pass between the upper heat application medium 21 and the lower heat application medium 24. When the solenoid 14 is then energized, the movable axes 15 is caused to descend to press protrusion **20*a* downward, so that the movable member 16 is lowered against the resilience of the spring 19. Thus, the upper heat application medium 21 depresses the image recording medium 3 toward the lower heat application medium 24** with a predetermined pressure.

The upper heat application medium 21 and the lower heat application medium 24 have been heated in advance to the respective image erasing temperatures, so that the images recorded on the image recording medium 3 can be instantly erased therefrom.

After the completion of image erasure, when the solenoid 14 is deenergized, the movable member 16 and the upper heat application medium 21 are returned to the respective original positions by the resilience of the spring 19 as shown in FIG. 5. Namely, the upper and lower heat application media 21 and 24 are separated from each other. Then, the image recording medium 3 is taken out of the image erasing apparatus.

In the above image erasing apparatus, when the image recording medium is held between a pair of heat application means and heat is applied thereto for image erasure, if a pair of heat rollers heat is employed as the heat application means and the erased image recording medium is then taken out by use of the pair of heat rollers, not only the object of the present invention, but also the following advantages can be obtained;

(a) The image recording medium is not scratched, or the scratching thereof, if any, is extremely slight, in the course of image erasure because the image recording medium is in a stationary state during image erasure.

(b) No or almost no dents are formed in the image recording medium in the course of image erasure because pressure is uniformly applied to both sides of the recording medium by a pair of the heat application means.

(c) Heat can be uniformly applied to the entire image area, so that image erasure can evenly and securely be carried out because a surface-to-surface contact can be attained between the image recording medium and the heat application means.

(d) The size of the image erasing apparatus can be reduced because of its simple structure.

Other features of this invention will become apparent in the course of the following description of exemplary embodiments which are given for illustration the invention and are not intended to be limiting thereof.

Fabrication of Image Display Medium No. 1

[Formation of Reversible Thermosensitive Recording Layer]

The following components were mixed to prepare a coating liquid for the formation of a reversible thermosensitive recording layers

| | Parts by Weight |
|---|---|
| Behenic acid | 7 |
| Eicosanedioic acid | 3 |
| Diisodecyl phthalate | 2 |
| Vinyl chloride - vinyl acetate copolymer resin (Trademark: "VYHH", made by Union Carbide Japan K.K) | 40 |
| THF | 150 |
| Toluene | 15 |

The thus prepared coating liquid was coated on a polyester film with a thickness of 50 μm, and dried, whereby a reversible thermosensitive recording layer was provided on the polyester film.

[Formation of Protective Layer]

The following components were mixed to prepare a coating liquid for the formation of a protective layer;

| | Parts by Weight |
|---|---|
| 75% butyl acetate solution of urethaneacrylate-based ultraviolet-curing resin (Trademark: "Unidic C7-157", made by Dainippon Ink & Chemicals, Incorporated.) | 10 |
| Toluene | 10 |

The thus prepared coating liquid was coated on the reversible thermosensitive recording layer, dried, and then subjected to UV curing by an ultraviolet lamp, so that a protective layer was formed on the reversible thermosensitive recording layer. Thus, a reversible thermosensitive recording film No. 1 was fabricated.

The thus fabricated reversible thermosensitive recording film No. 1 had such characteristics that the recording film assumed milky white opaque state at a second temperature of about 100° C. or more, and assumed a transparent state at a first temperature ranging from 70° to 100° C.

The reversible thermosensitive recording film No. 1 was attached to a card-shaped polyvinyl chloride plate with a thickness of 1 mm, whereby an image display medium No. 1 was obtained.

EXAMPLE 1

White opaque images were formed on the image display medium No. 1 by use of a thermal head. Then, the recorded white opaque images were erased by using an image erasing apparatus according to the present invention as shown in FIG. 7.

Figure 7:
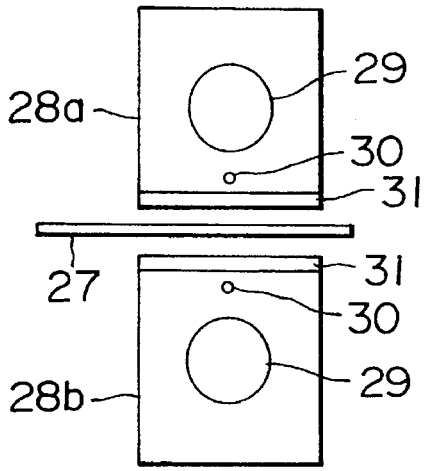
FIG. 7 is a schematic cross-sectional view of another example of an image erasing apparatus according to the present invention.

In the image erasing apparatus as shown in FIG. 7, reference numerals 28*a* and 28*b* indicate upper and lower hot stamps serving as heat plates; reference numeral 29, an electric heater; reference numeral 30, a temperature sensor; and reference numeral 31, a rubber plate.

To erase the images from the image display medium 27, the image display medium 27 was held between the upper hot stamp 28*a* which was heated to 90° C. and the lower hot stamp 28*b* which was heated to 60° C., with the front image-bearing side of the display medium 27 being in contact with the upper hot stamp 28*a*.

Such image formation and erasure was repeated 1,000 times using the image display medium No. 1.

A minimum heating time required to completely erase the white opaque images from the image display medium No. 1 at the 1000th image erasure operation was about 0.3 sec.

Comparative Example 1

White opaque images were formed on the image display medium No. 1 by use of a thermal head. Then, the recorded white opaque images were erased by using an image erasing apparatus as shown in FIG. 8.

Figure 8:
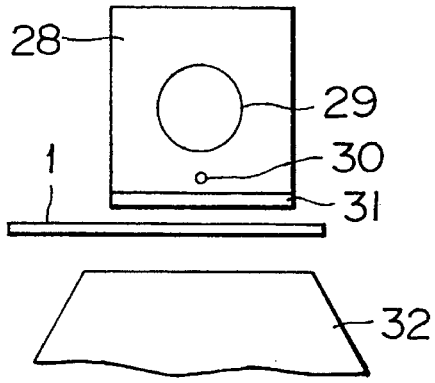
FIG. 8 PRIOR ART
FIG. 8 is a schematic cross-sectional view of a conventional image erasing apparatus comprising a heated plate as heat application means.

In the image erasing apparatus as shown in FIG. 8, reference numeral 28 indicates a hot stamp; reference numeral 29, an electric heater; reference numeral 30, a temperature sensor; reference numeral 31, a rubber plate; and reference numeral 32, a stamp base.

To erase the images from the image display medium 27, the hot stamp 28 which was heated to 90° C. was brought into contact with the front image-bearing side of the display medium 27 in such a manner that the display medium 27 was held between the hot stamp 28 and the stamp base 32.

such image formation and erasure was repeated 1,000 times by using the image display medium No. 1.

A minimum heating time required of completely erase the white opaque images from the image display medium No. 1 at the 1000th image erasure operation was about 0.5

Comparative Example 2

White opaque images were formed on the image display medium No. 1 by use of a thermal head. Then, the recorded white opaque images were erased by using an image erasing apparatus as shown in FIG. 8, with a back side of the display medium 27 being in contact with hot stamp 28 which was heated to 90° C. As a result, it took two seconds or more to erase the recorded images, and the image display medium No. 1 was deformed. Therefore, only one image formation and erasure test was conducted and no further tests were conducted.

EXAMPLE 2

[Fabrication of Image Recording Medium A]

The following components were mixed to prepare a coating liquid for a reversible thermosensitive recording layer:

| | Parts by Weight |
|---|---|
| Behenic acid (Trademark: "BA2225", made by Nippon Oil & Fats Co., Ltd.) | 7 |
| Eicosanedioic acid (Trademark: "SL-20", made by Okamura Oil Mill, Ltd.) | 3 |
| Diisodecyl phthalate | 2 |
| Vinyl chloride - vinyl acetate copolymer resin (Trademark: "VYHH", made by Union Carbide Japan K.K) | 40 |
| THF | 150 |
| Toluene | 15 |

The thus obtained coating liquid was coated on a polyester film with a thickness of 188 μm, serving as a support, and dried, whereby a reversible thermosensitive recording layer was provided on the support.

A coating liquid for the formation of a protective layer, comprising an ultraviolet-curing resin, was coated on the reversible thermosensitive recording layer, and dried, and then irradiated by an ultraviolet lamp, so that a protective layer was formed on the reversible thermosensitive recording layer.

Thus, a reversible thermosensitive recording film No. 2 was fabricated.

The thus fabricated reversible thermosensitive recording film No. 2 had such characteristics that the recording film assumed a milky white opaque state at a second temperature of about 100° C. or more, and assumed a transparent state at a first temperature ranging from 70° to 100° C.

The reversible thermosensitive recording film No. 2 was caused to assume a white opaque state by use of a thermal head in advance. Thereafter, the recording film No. 2 in a white opaque state was allowed to pass between a pair of heat-application rollers at a speed of 120 mm/sec to change the white opaque state into a transparent state, with the heat-application cycles with respect the front image-bearing side and the back side of the recording film No. 2 being controlled as shown in the graph of FIG. 1(*a*).

To compare with the above-mentioned image erasing method of the present invention, image erasure was carried out by heating only the front image-bearing side, or the back side of the recording film No. 2.

Figure 9:
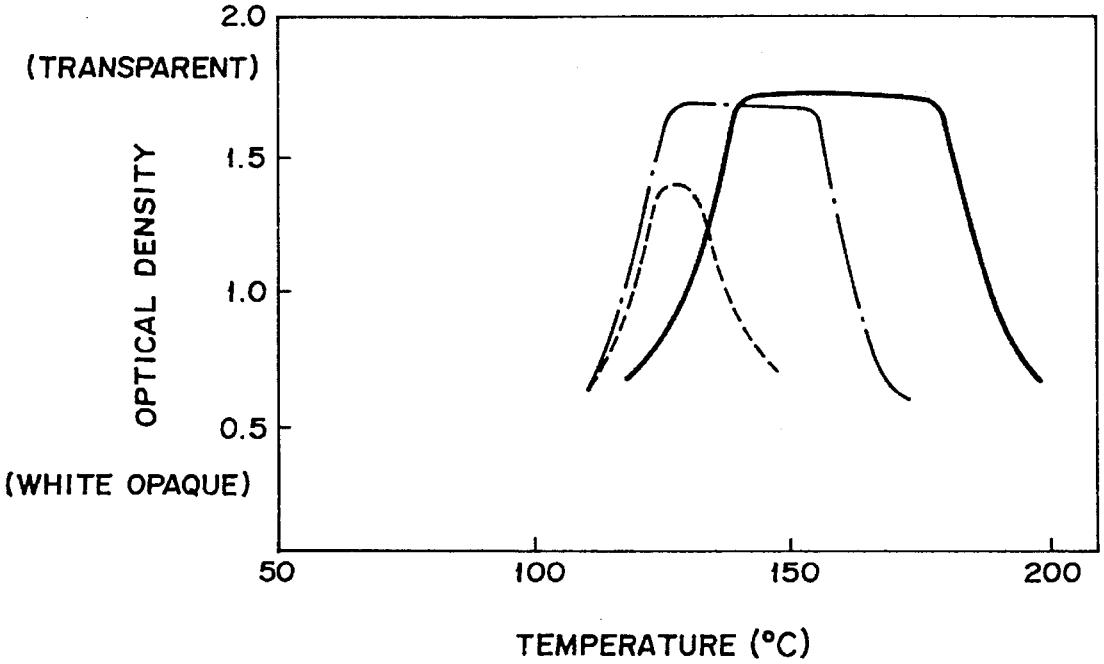
FIG. 9 is a graph showing the relationship between the temperature and the degree of transparency of a thermosensitive recording layer of a reversible thermosensitive recording material.

FIG. 9 is a graph which shows the relationship between the temperature of the recording film No. 2 and the transparency thereof. When both sides of the recording film No. 2 were heated to change the white opaque state of the recording film No. 2 into the transparent state, as indicated by an alternate long and short dash line in FIG. 9, the temperature region in which the reversible thermosensitive recording film No. 2 assumed a transparent state was larger as compared with the case where the heat was applied only to the reversible thermosensitive recording layer side, as indicated by a broken line in FIG. 9. In addition, the recording film No. 2 assumed a transparent state within a lower temperature region when heat was applied to both sides of the recording film No. 2, as compared with the case where the heat was applied only to the support side, as indicated by a solid line in FIG. 9. Even after such image formation and erasure was repeated 100 times, the same results were obtained.

Furthermore, for the image erasure, heat was applied to both the front image-bearing side and the back side of the recording film No. 2 in such a fashion that the heat-application period and phase with respect to both sides of the recording film No. 2 were made the same. As a result, some white opaque portions remained not erased.

EXAMPLE 3

[Fabrication of Image Recording Medium]

A reversible thermosensitive recording film No. 3 was prepared in the same manner as in Example 2 except that the polyester film with a thickness of 188 μm for use in the reversible thermosensitive recording film No. 2 was replaced by a polyester film with a thickness of 50 μm. Then, the polyester film of the reversible thermosensitive recording film No. 3 was attached to a polyvinyl chloride sheet with a thickness of 1 mm which was printed in black, so that an image recording medium B was obtained.

By using the image recording medium B, the same image formation and erasure test as described in Example 2 was carried out. As a result, the relationship between the temperature of the recording medium B and the transparency thereof was almost the same as shown in FIG. 9.

In the case where heat was applied only to the back side for the image erasure, the polyvinyl chloride sheet was deformed after the image formation and erasure was repeated 50 times.

What is claimed is:

1. An apparatus for erasing images recorded in an image recording medium comprising:

first and second heat application means for respectively applying heat to a front image bearing side and a back side of an image recording medium for erasing images, with said image recording medium being interposed between said first and second heat application means;

biasing means for urging one of said first and second heat application means in a first direction;

means for moving said one of said first and second heat application means in a second direction, wherein said second direction is an opposite direction to said first direction;

a movable member upon which said one of said first and second heat application means is mounted;

a fixed frame assembly;

wherein said biasing means is connected to said movable member and said fixed frame assembly for biasing said one of said first and second heat application means away from the other of said first and second heat application means; and wherein said fixed frame assembly includes first and second side walls, each of said first and second side walls including first and second slots, and wherein a first guide bar is connected to said movable member and extends into the first slot of said first side wall and the first slot of said second side wall, and a second guide bar is connected to said movable member and extends into the second slot of said first side wall and the second slot of said second side wall, the apparatus further including a third guide bar connected to said movable member and a fourth guide bar connected to said movable member, said third guide bar extending into the first slot of said first side wall and the first slot of said second side wall, said fourth guide bar extending into the second slot of said first side wall and the second slot of said second side wall.

2. An apparatus as recited in claim 1, wherein said means for moving moves said one of said first and second heat application means toward the other of said first and second heat application means.

3. An apparatus as recited in claim 1, wherein said means for moving includes an actuator having an opening therein, said opening receiving a protrusion, and wherein said protrusion is connected to said movable member.

4. An apparatus as recited in claim 3, wherein said actuator comprises a solenoid.

5. An apparatus as recited in claim 1, wherein said first heat application means is mounted on said movable member and said second heat application means is mounted on said fixed frame assembly.

6. An apparatus as recited in claim 1, wherein at least one of said first and second heat application means includes a heating element comprising a plane heating surface.

7. An apparatus as recited in claim 1, wherein at least one of said first and second heat application means includes a cushioning surface.

8. An apparatus for erasing images recorded in an image recording medium comprising:

first and second heat application means for respectively applying heat to a front image bearing side and a back side of an image recording medium for erasing images, with said image recording medium interposed between said first and second heat application means;

a fixed frame assembly including first and second side walls, each of said first and second side walls including a first slot;

a movable member; and a first guide bar connected to said movable member, said first guide bar extending into said first slot of each of said first and second side walls;

wherein one of said first and second heating means is mounted on said movable member; and the apparatus further including an actuator having an opening therein, and a protrusion mounted on said movable member, said protrusion extending into said opening of said actuator;

wherein said first and second side walls each further include a second slot, and wherein a second guide bar is connected to said movable member and extends into the second slot of said first side wall and the second slot of said second side wall.

9. An apparatus as recited in claim 8, further including biasing means connected between said fixed frame assembly and said movable member for urging said movable member in a first direction.

10. An apparatus as recited in claim 8, further including a third guide bar connected to said movable member and extending into the first slot of each of said first side wall and said second side wall, and a fourth guide bar connected to said movable member, and extending into the second slot of each of said first side wall and said second side wall.

11. An apparatus as recited in claim 8, further including a third guide bar connected to said movable member and extending into the first slot of each of said first side wall and said second side wall, and a fourth guide bar connected to said movable member, and extending into the second slot of each of said first side wall and said second side wall.

12. An apparatus as recited in claim 8, wherein at least one of said first and second heat application means includes a heating element comprising a plane heating surface.

13. An apparatus as recited in claim 8, wherein at least one of said first and second heat application means includes a cushioning surface.

14. An apparatus for erasing images recorded in an image recording medium comprising:

first and second heat application means for respectively applying heat to a front image bearing side and a back side of an image recording medium for erasing images, with said image recording medium interposed between said first and second heat application means;

a fixed frame assembly including first and second side walls, each of said first and second side walls including a first slot;

a movable member;

a first guide bar connected to said movable member, said first guide bar extending into said first slot of each of said first and second side walls;

biasing means connected between said fixed frame assembly and said movable member for urging said movable member in a first direction, the apparatus further including an actuator for moving said movable member in a second direction opposite to said first direction;

wherein said first and second side walls each further include a second slot, and wherein a second guide bar is connected to said movable member and extends into the second slot of said first side wall and the second slot of said second side wall;

the apparatus further including a third guide bar connected to said movable member and extending into the first slot of each of said first side wall and said second side wall, and a fourth guide bar connected to said movable member, and extending into the second slot of each of said first side wall and said second side wall; and a protrusion extending from said movable member and into an opening of said actuator;

wherein said first heat application means is mounted upon said movable member and said second heat application means is mounted upon said fixed frame assembly.

15. An apparatus as recited in claim 11, wherein said first heat application means is mounted upon said movable member and said second heat application means is mounted upon said fixed frame assembly.

* * * * *

UNITED STATES PATENT AND TRADEMARK OFFICE

CERTIFICATE OF CORRECTION

PATENT NO. : 5,616,262
DATED : April 1, 1997
INVENTOR(S) : KOUICHI ITODA ET AL

It is certified that error appears in the above-indentified patent and that said Letters Patent is hereby corrected as shown below:

In column 1, line 18, change "various" to --Various--;

line 60, change "shorn" to --short--;

line 65, delete "is". (2nd occurrence).

In column 2, line 27, change "e" to --a--.

In column 3, line 27, change "en" to --an--;

line 67, change "shafted" to --shifted--.

In column 4, line 62, after "and" insert --4--.

In column 5, line 38, change "current$_1$" to --currently--.

UNITED STATES PATENT AND TRADEMARK OFFICE

CERTIFICATE OF CORRECTION

PATENT NO. : 5,616,262

DATED : April 1, 1997

INVENTOR(S) : KOUICHI ITODA ET AL

It is certified that error appears in the above-indentified patent and that said Letters Patent is hereby corrected as shown below:

In column 6, line 14, change "profrusion" to --protrusion--, same line change "in" to --is--;
line 19, change "head" to --heat--;
line 31, change "when" to --When--;
line 65, change "heat is" to --are--.
In column 8, line 49, change "such" to --Such--;
line 51, change "of" to --to--.
In column 10, line 10, after "Medium" insert --B--.

Signed and Sealed this

Twenty-fifth Day of November, 1997

*Attest:*

*Attesting Officer*

BRUCE LEHMAN

*Commissioner of Patents and Trademarks*